US010648241B2

(12) United States Patent
Roodenburg et al.

(10) Patent No.: US 10,648,241 B2
(45) Date of Patent: May 12, 2020

(54) MARINE RISER SECTION FOR SUBSEA WELLBORE RELATED OPERATIONS

(71) Applicant: ITREC B.V., Schiedam (NL)

(72) Inventors: Joop Roodenburg, Schiedam (NL); Diederick Bernardus Wijning, Schiedam (NL); Peter Madlener, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 15/517,637

(22) PCT Filed: Oct. 9, 2015

(86) PCT No.: PCT/NL2015/050712
§ 371 (c)(1),
(2) Date: Apr. 7, 2017

(87) PCT Pub. No.: WO2016/056914
PCT Pub. Date: Apr. 14, 2016

(65) Prior Publication Data

US 2017/0241212 A1 Aug. 24, 2017

(30) Foreign Application Priority Data

Oct. 10, 2014 (NL) ..... 2013614
Dec. 9, 2014 (NL) ..... 2013942

(51) Int. Cl.
*E21B 17/01* (2006.01)
*E21B 7/12* (2006.01)
(Continued)

(52) U.S. Cl.
CPC ..... *E21B 17/012* (2013.01); *E21B 17/085* (2013.01); *E21B 17/18* (2013.01); *E21B 19/155* (2013.01)

(58) Field of Classification Search
None
See application file for complete search history.

(56) References Cited

U.S. PATENT DOCUMENTS 7,214,114 B2 * 5/2007 Gibson ..... E21B 17/012 441/133
7,628,665 B1 * 12/2009 Cook ..... E21B 17/012 405/195.1
(Continued)

FOREIGN PATENT DOCUMENTS

WO WO 2009/102196 A2 8/2009
WO WO 2014/188471 A1 10/2014

OTHER PUBLICATIONS

US 3,728,766 A, 06/1973, Cook et al. (withdrawn)

*Primary Examiner* — Matthew R Buck
*Assistant Examiner* — Douglas S Wood
(74) *Attorney, Agent, or Firm* — Birch, Stewart, Kolasch & Birch, LLP

(57) ABSTRACT

A drilling marine riser section comprises a main riser pipe with radially extending flanges and multiple auxiliary pipes at least comprising a choke line and a kill line. One or more clamps retain the auxiliary pipes. Further the riser section has buoyancy members. The choke line and the kill line are connected to each of the flanges in a tensile load sharing arrangement, so that—in vertical use orientation of the riser section in a riser string—weight stress is distributed in the main riser pipe and the choke line and the kill line. The buoyancy members form an exterior of the riser section including diametrically opposed and parallel flat bottom and top stacking faces relative to the axis of the main riser pipe, allowing stacking of riser sections in horizontal orientation. The choke line and the kill line are arranged diametrically opposite from one another and between the flat bottom and top stacking faces.

13 Claims, 12 Drawing Sheets

Figure 1:
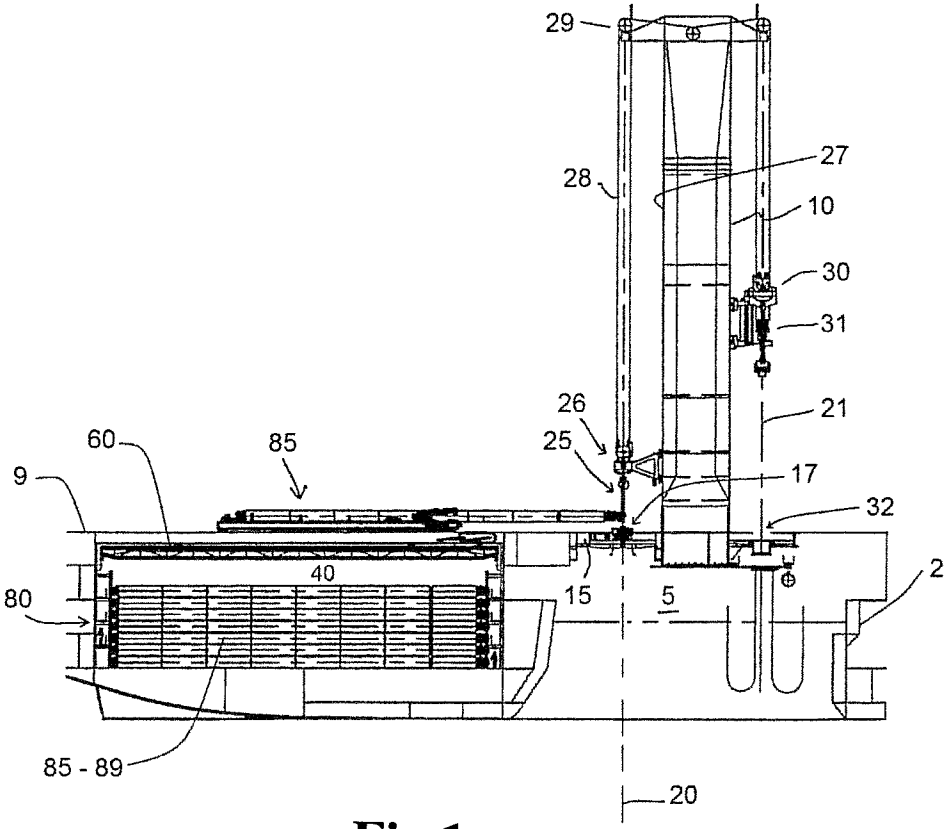

(51) Int. Cl.

| | |
|---|---|
| ***E21B 19/14*** | (2006.01) |
| ***B63B 35/03*** | (2006.01) |
| ***E21B 17/08*** | (2006.01) |
| ***E21B 17/18*** | (2006.01) |
| *E21B 19/15* | (2006.01) |

(56) References Cited

U.S. PATENT DOCUMENTS

| | | | | |
|---|---|---|---|---|
| 8,322,438 | B2 * | 12/2012 | Larson | E21B 17/012 166/367 |
| 8,540,029 | B2 * | 9/2013 | McMiles | E21B 17/01 166/345 |
| 9,624,735 | B2 * | 4/2017 | Pezet | E21B 17/01 |
| 9,719,313 | B2 * | 8/2017 | Mission | E21B 19/143 |
| 2003/0068941 | A1 | 4/2003 | Oram | |
| 2005/0241832 | A1 | 11/2005 | Jones et al. | |
| 2010/0086378 | A1 | 4/2010 | Lin | |
| 2010/0270025 | A1 | 10/2010 | Larson et al. | |
| 2010/0300699 | A1 | 12/2010 | Papon et al. | |
| 2012/0217017 | A1 | 8/2012 | Zediker | |
| 2016/0230475 | A1 * | 8/2016 | Haddad | E21B 17/012 |

* cited by examiner

MARINE RISER SECTION FOR SUBSEA WELLBORE RELATED OPERATIONS

The present invention relates to the field of subsea wellbore related operations wherein a riser string composed of marine riser sections extends between a vessel adapted to perform subsea wellbore related operations and a subsea wellbore, e.g. drilling and/or wellbore intervention operations.

The present invention also relates to a riser string extending between a vessel and a subsea wellbore.

The present invention also relates to a marine riser section.

In the prior art it is common to store the multiple riser sections from which the subsea riser string is composed in a riser storage of the vessel.

Commonly a riser section comprises a riser pipe and additionally one or more auxiliary pipes, also called satellite, service, or peripheral pipes or lines, on the outside of and parallel along the riser pipe. The auxiliary pipes are e.g. used as fluid lines, e.g. to a BOP or other subsea equipment, as choke line, kill line, hydraulic line, booster line, injection line (e.g. for glycol), etc.

In a common design the main riser pipe is provided at each end thereof with a radially extending flange, the main pipe and the flanges being made of steel. One or both of the flanges may have bolt holes allowing to join riser sections by means of bolts and nuts.

An auxiliary pipe may have an individual connector fitting at its end or ends, e.g. a bayonet fitting, or be designed to fit sealingly into the auxiliary pipe of an adjoining riser section.

Riser sections come in different lengths. Commonly riser sections have lengths between 50 ft. (15.24 meters) and 90 ft. (27.43 meters). A very common length for riser sections is 75 ft. (22.86 meters).

Riser sections are commonly heavy; far heavier than other tubulars used in the offshore drilling industry. For example a single 75 ft. subsea riser section may weigh between 20 and 25 tonnes, which is incomparable to the weight of an equally long drill pipe. Therefore riser handling is subject to different considerations than drill pipe handling, mainly in view of their size (diameter) and weight.

For example WO2009/102196 discloses a mono-hull vessel having a hull and a riser storage hold within the hull. In the riser storage hull riser sections are stacked in their horizontal orientation. A gantry crane is provided to raise and lower the riser sections out of and into the storage hold and to place each individual riser section onto a riser catwalk machine or to pick up a riser section from the catwalk machine. The leading end of the riser section is in practice connected to a riser string lifting tool which connects the riser section to a riser string handling capacity hoisting device of the vessel. By raising the lifting tool and operation of the catwalk machine the riser section is brought into a vertical orientation, or upended, in line with a firing line along which the riser string is suspended into the sea. The already launched portion of the riser string is then temporarily held by a riser string hanger, often referred to as a riser spider, of the vessel. The new riser section is then held in alignment above the launched riser string and the connector fitting arrangements are interconnected to join the new riser section to the riser string. Then the riser string is released by the riser string hanger and lowered over the length of the newly attached section. The riser string is then suspended again from the riser string hanger and the process of joining a new riser section is repeated.

It has been found that this known process to assemble a riser string is time-consuming. In particular a great deal of effort has to be made to properly make up the connections between the riser sections. In particular in view of desired or required testing of each connection that has been made up the known process is undesirably slow.

In WO2014/168471 it is proposed to use 150 ft. riser sections which are stored aboard the vessel and upended and arranged in the firing line that is related to the riser string assembly process. In the context of the present invention it is envisaged that riser assembly and disassembly may be performed in a dedicated firing line that is separate from a drilling firing line, but it may also be done in one and the same firing line with drilling activities.

In WO2014/168471 a vessel is disclosed having a riser storage hold within the hull below the deck. The riser storage hold comprises storage racks adapted to store therein parallel stacks of multiple riser sections and/or pre-assembled riser stands in horizontal orientation. The vessel is provided with an elongated riser transfer opening between the deck and the roof of the storage hold. This riser transfer opening extends in a direction parallel to the storage racks and has a length and a width so as to allow for transfer of a single riser section or a single riser stand in horizontal orientation via the riser transfer opening out of and into the riser storage hold. The vessel is further provided with a riser transfer station arranged within the riser storage hold below the riser transfer opening. This station is provided with a transfer elevator that is adapted to raise and lower a single riser section or a single riser stand in horizontal orientation thereof so as to pass the riser section or a riser stand through the riser transfer opening. Within the riser storage hold an overhead travelling beam crane is arranged, which crane is adapted to lift and lower a single riser section or a single riser stand at least allowing for removal of a single riser section or a single riser stand riser stand from a storage rack and for placing a single riser section or a single riser stand into a storage rack respectively. The crane is also adapted for transverse transportation of a single riser section or a single riser stand at least between the transfer station and a position above a storage rack.

One issue associated with the handling, in particular upending, of long, e.g. 150 ft. long riser sections, in particular when they are provided with buoyancy members, is the enormous stress to which the riser section is subjected in the upending process as the riser section tends to bend in that process.

The present invention has as an aim to provide an improved or at least alternative marine riser section, e.g. to perform drilling activities, e.g. in view of the desire to have riser sections of great length, e.g. of 150 ft.

The present invention also aims to provides measures that allow for the efficient deployment of long drilling marine riser sections including an upending process wherein the riser section is brought from a horizontal position into a vertical position, and a reverse process during tripping of the riser string, preferably without the need to resort to the use of a strongback or allowing for a reduction of the strength requirements of a strongback. The latter may e.g. allow for a rather simple strongback, e.g. as a beam structure extending along a single side of the riser section at the start of the upending process and/or for example allowing for a relatively lightweight synthetic composite structure of the strongback facilitating its handling and reducing load on the riser lifting system.

A first aspect of the invention proposes a drilling marine riser section comprising:

a main riser pipe, said main riser pipe having an axis and a length, wherein said main riser pipe is provided with a radially extending flange at each end thereof, multiple auxiliary pipes disposed on the outside of and parallel to the riser pipe, said auxiliary pipes at least comprising a choke line and a kill line, one or more clamps distributed along the length of the main riser pipe and secured to said main riser pipe, said one or more clamps being adapted to retain at least said choke line and said kill line relative to the main riser pipe, buoyancy members, wherein, preferably, said riser section has a length of at least 100 ft. (30.48 m), e.g. of 120 ft. (36.57 m) or 150 ft. (45.72 m), and wherein at least the choke line and the kill line are connected to each of the flanges in a tensile load sharing arrangement with a tensile load transferring connection assembly between each of the choke line and kill line and each of the flanges, so that—in vertical use orientation of the riser section in a riser string—weight stress is distributed in the main riser pipe and the choke line and the kill line, and wherein the buoyancy members form an exterior of the riser section including diametrically opposed and parallel flat bottom and top stacking faces relative to the axis of the main riser pipe, allowing stacking of riser sections in horizontal orientation with the flat bottom stacking face resting on the flat top stacking face of an underlying riser section, and wherein the choke line and the kill line are arranged diametrically opposite from one another relative to the axis of the main riser pipe and between the flat bottom and top stacking faces, preferably in a plane normal to the flat bottom and top stacking faces.

The inventive riser section of the first aspect can be removed from the top of a stack by horizontally lifting the riser section, e.g. with an overhead beam crane, and then supplied, still in horizontal position, to an upending system for the riser section, e.g. to a catwalk machine of such a system. When upending the riser section from horizontal orientation to vertical orientation by lifting one end of the riser section, e.g. with the other end supported on a skate of a catwalk machine, bending induced tensile loads in the riser section are distributed primarily in the main riser pipe and the lower one of the choke line and kill line.

The first aspect of the invention thus provides for a riser section design that allows for an optimal use of the sturdy choke line and kill line to deal with the great loads that are experienced during the upending of the riser section.

In embodiments it is envisaged that the choke line and kill line are steel pipes having a 1 inch wall thickness.

In embodiment it is envisaged that the choke line and kill line are pressure rated at 15.000 psi which is a practical demand for deepwater applications, e.g. for water depths of 10.000 ft. or more. The pressure rating already require these lines to be very sturdy and the inventive riser section optimally makes use of this sturdiness in view of the upending process from a horizontal initial or storage position to the vertical position in the firing line for deployment of the riser string.

This issue of very significant loads occurring during upending, is particularly of interest when handling very long riser sections, e.g. riser sections having a length of at least 100 ft. (30.48 m), e.g. of 120 ft. (36.57 m) or 150 ft. (45.72 m). A 150 ft. riser section equipped with buoyancy members, may in practical embodiments weigh—with a steel main riser pipe of 21 inch outer diameter and 18.75 inch inner diameter and with steel kill and choke lines of 6.5 inch OD, 4.5 inch ID, rated at 15.000 psi—between 45 and 55 metric tons. This enormous weight in combination with the length of 150 ft. gives rise to the very significant loads during upending.

In a practical embodiment the main riser pipe and its flanges are made of solid steel, e.g. X80 steel for at least the main riser pipe.

In a practical embodiment the main riser pipe has a 21 inch outer diameter and 18.75 inch inner diameter, e.g. a steel main riser pipe, e.g. made of X80 steel.

In a practical embodiment each of the kill line and choke line has 6.5 inch OD and a 4.5 inch ID, e.g. made of solid steel.

In practical embodiments in a 150 ft. riser section the buoyancy members may make up a significant percentage of the total dry weight of the riser section, e.g. between 15 and 20 tons dry weight of buoyancy members may be provided on a 150 ft. riser section.

It is noted that choke lines and kill lines have been developed wherein a hybrid steel and composite pipe structure is employed, with a steel inner tubular core and a composite material wrapping around the steel core. These hybrid lines may also be employed in the context of the present invention. For example such a hybrid line may have a 15.000 psi pressure rating.

In an embodiment each of the pair of buoyancy members has in cross section a semi-circular outer side. That is, the pair of buoyancy member comprises, in cross section, a circular outer edge, wherein the top and bottom of the circular outer edge are levelled off to create parallel flat bottom and top stacking faces relative to the axis of the main riser pipe.

In an embodiment the tensile load transferring connection assembly between each of the choke line and of the kill line and each of the flanges is embodied such that—when upending the riser section from a horizontal orientation to a vertical orientation by lifting one end of the riser section—the upper one or the choke line and kill line does not carry a compressive load. So only the lowermost of the two lines—seen when the riser section is horizontal and during the upending process—acts to carry tensile load, the other of the two lines does not and neither does that other line carry any significant compressive load so that buckling problems are avoided.

In an embodiment a tensile load transferring connection assembly comprises:

a multi-stepped bore through the flange, said bore having an axis and said bore having multiple adjoining step portions, each step portion including a peripheral surface and a shoulder surface, with the axially spaced shoulder surfaces of the multi-stepped bore having stepwise decreasing diameter relative to one another when seen in direction of the tensile load on the choke line or kill line, e.g. at least a three stepped bore with three shoulder surfaces, a multi-stepped end fitting arranged on the respective auxiliary pipe, said end fitting having a multiple adjoining step portions, each step portion including a peripheral surface and a shoulder surface, with the axially spaced shoulder surfaces of the multi-stepped end fitting having stepwise decreasing diameter relative to one another when seen in direction of the tensile load on the choke line or kill line, e.g. at least a three stepped bore with three shoulder surfaces, wherein the shoulder surfaces of the multi-stepped bore and of the multi-stepped end fitting are adapted to simultaneously contact one another so as to distributed the tensile load to be transferred over said shoulder surfaces.

Such a tensile load transferring connection assembly is preferably provided at each end of both the kill line and the choke line. It will be appreciated that the same assembly can also be employed in riser sections wherein other auxiliary lines than the choke line and kill line are employed as tensile load sharing members in the riser section.

The provision of a multi-stepped bore and mating end fitting allows for the optimization of the transfer of loads between the auxiliary pipe and the respective flange as, more or less, this load is distributed over the length of the multi-stepped bore. In a known prior art design a single shouldered bore is present, so the load is focused on a single shoulder, e.g. halfway the bore. The distribution of the load over multiple shoulders along the length of the bore in the flange allows for optimized load transfer and use of the strength of the flange, which may, in embodiments be a solid steel flange, e.g. with a thickness or effective length of the bore, between 4 inch and 8 inch, e.g. between 5 and 7 inch, e.g. 6 inch.

The multi-stepped bore is also advantageous compared to a cone-in-cone arrangement, wherein the bore is conical over its effective length and the auxiliary pipe carries a conical end fitting mating with said conical bore. This single cone arrangement leads to undesirable lateral stresses in the flange as a resultant of tensile load on the auxiliary pipe, which lateral stresses seek to widen the bore and unduly stress the flange.

In an embodiment at least one pair of contacting shoulder surfaces of the multi-stepped bore and end fitting are located in a plane normal to the axis of the bore. The normal orientation of the mating surfaces establishes that a tensile load does not, or very little, translate into lateral stress onto the flange.

In an embodiment at least one pair of contacting shoulder surfaces of the multi-stepped bore and end fitting are located in a conical plane that tapers when seen in direction of tensile load on the choke line or kill line, said conical plane having an angle of at most 20° relative to a plane that is normal to the axis of the bore. Due to the limit cone angle the tensile load absorbed by the respective pair of mating surfaces only results in a rather limited widening effect on the flange material around the bore, which may be seen in terms of a box around the pin formed by the auxiliary line or end piece thereof. As the angle is smaller the lateral stress also will be smaller. An advantage of having at least one such conical shoulder can be the centering effect, whereby the auxiliary pipe is centered relative to the bore in the flange.

In an embodiment at least one pair of contacting shoulder surfaces of the multi-stepped bore and end fitting are located in a conical plane that widens when seen in direction of tensile load on the choke line or kill line, said conical plane having an angle of at most 20° relative to a plane that is normal to the axis of the bore. This arrangement, that e.g. could be provided for just one pair of mating surfaces, e.g. the pair near the outer end face of the flange, may be provided to cause a contracting effect of the material of the flange that surrounds the bore, so a contraction of the box upon tensile loading of the auxiliary line.

In an embodiment the multi-stepped end fitting is embodied as a nut, wherein the respective auxiliary pipe is provided with a threaded portion onto which the nut is screwed allowing to adjust the position of the end fitting. For example the auxiliary pipe having a steel pipe end piece welded on a steel main body of the auxiliary pipe. The provision of the nut embodiment may allow to efficiently tune the proportion of the tensile load that is absorbed by the respective auxiliary line compared to the portion absorbed by the main riser pipe. The nut also allows for an efficient structure, e.g. one that allows for an easy replacement of the auxiliary line, e.g. when maintenance is performed.

In an embodiment a lock nut is also provided on the threaded portion of the auxiliary pipe allowing to lock the multi-stepped end fitting nut in a desired position.

In an embodiment the bore for the auxiliary pipe in the flange has a length of between 4 inch and 8 inch, e.g. between 5 and 7 inch, e.g. 6 inch.

For example the multi-stepped bore has three steps with three shoulder faces and the end fitting also has three shoulders, e.g. the bore having a length between 4 inch and 8 inch.

In an embodiment the, or each, flange is provided with two bolt holes near each of the kill line bore and the choke line bore in the flange, one bolt hole on each side of the respective kill line and choke line. Possibly the or each flange is furthermore provided with two additional pairs of bolt holes for connector bolts that interconnect adjoining riser sections, said additional pairs each being arranged on opposite sides of the main riser pipe, the bolt holes of each pair being distributed between the bolt holes adjacent the respective choke line and kill line.

In an embodiment the main riser pipe is a metal pipe, preferably a steel pipe, and at least one clamp, preferably all clamps, that retain the one or more auxiliary pipes, has a metal, preferably steel, discontinuous clamping band with multiple band members that are in direct metal-to-metal contact with the metal main riser pipe, wherein the clamp comprises one or more fasteners to secure the band members to one another and to create a friction clamping of the clamping band onto the main riser pipe, wherein the friction is such that—when lifting one end of the riser section in the process of upending the riser section from the horizontal orientation into the vertical orientation—the band of the clamp holding the choke line and kill line remains in place relative to the riser pipe, at least concerning its angular position relative the main riser pipe.

The provision of the above design of the clamp avoids that the choke and kill line shift relative to the main riser pipe under the loads on the riser during the upending process. Such shift is not desired as it may reduce, or render ineffective, the contribution of the lower one of these lines to the tensile force absorption within the riser section. The design is based on the inventive insight that these lines, due to the loads and bending of the riser section during upending, tend to leave their initial straight shape parallel to the main riser pipe in this process and more or less become a swirly shape.

In an embodiment the riser section has a length of at least 100 ft. (30.48 m), e.g. of 120 ft. (36.57 m) or 150 ft. (45.72 m), wherein the riser section is provided at intermediate locations along the length thereof with two riser gripper engageable portions having a spacing corresponding to the spacing between end portions of a 75 ft. (22.86 meters) riser section. The provision of such spaced apart riser gripper engageable portions, e.g. on a 150 ft. riser section, greatly reduces the loads during horizontal handling of the riser section, e.g. when stacking or de-stacking the riser section using a crane. In an embodiment each gripper engageable portion comprises a hook member fitted to the riser section, e.g. a hook integrated with a collar that is fitted around the main riser pipe.

A second aspect of the present invention relates to a marine riser section, wherein at least the choke line and the kill line are connected to each of the flanges in a tensile load sharing arrangement with a tensile load transferring connection assembly between each of the choke line and kill line and each of the flanges, so that—in vertical use orientation of the riser section in a riser string—weight stress is distributed in the main riser pipe and the choke line and the kill line, and wherein a tensile load transferring connection assembly comprises:

a multi-stepped bore through the flange, said bore having an axis and said bore having multiple adjoining step portions, each step portion including a peripheral surface and a shoulder surface, with the axially spaced shoulder surfaces of the multi-stepped bore having stepwise decreasing diameter relative to one another when seen in direction of the tensile load on the choke line or kill line, e.g. at least a three stepped bore with three shoulder surfaces, a multi-stepped end fitting arranged on the respective auxiliary pipe, said end fitting having a multiple adjoining step portions, each step portion including a peripheral surface and a shoulder surface, with the axially spaced shoulder surfaces of the multi-stepped end fitting having stepwise decreasing diameter relative to one another when seen in direction of the tensile load on the choke line or kill line, e.g. at least a three stepped bore with three shoulder surfaces, wherein the shoulder surfaces of the multi-stepped bore and of the multi-stepped end fitting are adapted to simultaneously contact one another so as to distributed the tensile load to be transferred over said shoulder surfaces.

It will be appreciated that the benefits of the multi-stepped bore and mating end fitting as discussed above are applicable to the second aspect of the invention. Equally all embodiments as discussed above of the bore and mating end fitting, as well as each and every other technical feature address with reference to the first aspect of the present invention can be combined, e.g. in various combinations of such features, with the riser section mentioned above in the second aspect.

A third aspect of the present invention relates to a marine riser section, wherein, preferably, said riser section has a length of at least 100 ft. (30.48 m), e.g. of 120 ft. (36.57 m) or 150 ft. (45.72 m), and wherein at least the choke line and the kill line are connected to each of the flanges in a tensile load sharing arrangement with a tensile load transferring connection assembly between each of the choke line and kill line and each of the flanges, so that—in vertical use orientation of the riser section in a riser string—weight stress is distributed in the main riser pipe and the choke line and the kill line, wherein the riser pipe is a metal pipe, preferably a steel pipe, and wherein at least one clamp, preferably all clamps, has a metal, preferably steel, discontinuous clamping band with multiple band members that are in direct metal-to-metal contact with the metal main riser pipe, wherein the clamp comprises one or more fasteners to secure the band members to one another and to create a friction clamping of the clamping band onto the main riser pipe, wherein the friction is such that—when lifting one end of the riser section in the process of upending the riser section from the horizontal orientation into the vertical orientation—the band of the clamp holding the choke line and kill line remains in place relative to the riser pipe, at least concerning its angular position relative the main riser pipe.

It will be appreciated that the benefits of the clamp or clamps as discussed above with reference to the first aspect of the invention are applicable to the third aspect of the invention. Equally all embodiments as discussed above, as well as each and every other technical feature addressed with reference to the first and/or second aspect of the present invention can be combined, e.g. in various combinations of such features, with the riser section mentioned above in the third aspect.

The aspects of the invention also relate to a method for assembly of a riser string by interconnection of riser sections to compose a riser string that is adapted to extend between a vessel adapted to perform subsea wellbore related operations and a subsea wellbore, e.g. in a drilling and/or wellbore intervention operation, with method comprises:

upending the riser section from a horizontal initial orientation by connecting a leading end of the riser section to a riser string lifting tool which connects the riser section to a riser string handling capacity hoisting device of the vessel, then raising the lifting tool, and, e.g. with the aid of a catwalk machine having a skate supporting the rear end of the riser section, bringing the riser section into a vertical or upended orientation in line with a firing line along which the riser string is suspended into the sea.

In said horizontal initial orientation of the riser section the choke and kill line are arranged between the flat bottom and top stacking faces. Therefore during upending the choke and kill line remain above and below the main riser pipe. As a result, during the upending the sturdy choke and kill line are optimally used in dealing with the great loads that are experienced during the upending of the riser section.

In an embodiment of said method the upper one of the choke line and kill line does not carry a compressive load during upending the riser section from a horizontal orientation to a vertical orientation by lifting one end of the riser section.

A fifth aspect of the invention relates to a riser string that extends, or can be assembled and extended, between a subsea wellbore and a subsea wellbore operations vessel, e.g. a drilling vessel. The riser string comprises an first string part composed of interconnected first length riser sections and a second string part composed of interconnected second length riser sections, wherein the first length riser sections are longer than the second length riser sections, e.g. twice as long, and wherein the first length riser sections and the second length riser sections are each provided with buoyancy members. The buoyancy members of the second length riser sections have a greater depth rating than the buoyancy members of the first length riser sections.

The inventive riser string has a length of between 10.000 and 14.000 ft., wherein the first string part is composed of first length riser sections extends to a depth between 7.000 and 9.000 ft., and the second string part is composed of second length riser section extends to a depth of at most 12.000 ft., and—when the riser extends below 12.000 ft.—, the riser string having a lowermost third string part comprising, preferably being composed of, bare first length riser sections.

The invention envisages as particularly advantageous for practical use an embodiment wherein the first length is 150 ft. and the second length is 75 ft.

In the inventive riser string the heavier buoyancy members, corresponding to the greater depth rating as the members have to resist the water pressure, are mounted on the shorter riser sections. The relatively lighter buoyancy members are fitted on the longer riser sections. This allows for an efficient handling and assembly process of the riser sections, as no individual riser section will have to become unduly heavy. For example the second length riser section can be 75 ft. with a dry weight between 27 and 34 tons. For example the first length riser sections can be 150 ft. with a dry weight between 45 and 55 tons.

In an embodiment, e.g. also compatible with riser section according any of the first, second, third, and/or fourth aspect of the invention, each first length riser section comprises a first series of adjacent buoyancy members and a second series of adjacent buoyancy members, wherein a mid-portion between said first and second series the riser section is bare, said bare mid-portion having a length of between 30 and 60 ft. This design places the weight of the buoyancy members towards the outer ends of the riser section, which is e.g. advantageous in view of the bending loads present when the riser section is upended from a horizontal into a vertical orientation.

In an embodiment each series of adjacent buoyancy members comprises three adjacent groups of buoyancy members, each group arranged around the main riser pipe and, possibly around one or more auxiliary pipes of the riser section, wherein a hook member is fitted to the riser section between the second and third group of each series seen from the respective end of the riser section, said hook members being adapted to lift the riser section in horizontal orientation thereof. The hooks thus are close to the weight of the buoyancy members and also the weight of the riser section is carried in an attractive manner by a two-point suspension. For example the hooks are spaced apart about equal to the end portions of a 75 ft. riser section.

The present invention also relates to vessel adapted to perform subsea wellbore related operations involving a riser string between the subsea wellbore and the vessel, e.g. drilling and/or wellbore intervention, said vessel comprising a hull having a deck, said vessel comprising:

a riser storage, e.g. a riser storage hold present within said hull below said deck, wherein the riser storage is provided with first length storage racks adapted to store therein—in vertical stacks—single first length riser sections each having a length of at least 100 ft. (30.48 m), e.g. of 120 ft. (36.57 m) or 150 ft. (45.72 m), and wherein the riser storage is provided with second length storage racks adapted to store therein single second length riser sections (95) each having a length of between 50 ft. (15.24 meters) and 90 ft. (27.43 meters), e.g. of 75 ft. (22.86 meters).

which at least multiple first length riser sections according to one or more of the other aspects discussed herein are stored in the first length storage racks.

In a very practical embodiment there are storage racks dedicated to 150 ft. (45.72 m) riser sections and storage racks dedicated to 75 ft. (22.86 meters) riser sections.

Through the use of long, e.g. 150 ft., riser sections stored in the riser storage the time needed for deployment and/or retrieval of a riser string is reduced compared to the present practice wherein mostly 75 ft. riser sections are interconnected in the firing line. The use of long riser sections for example allows to bring up the blow-out preventer or a module thereof attached to the lower end of the riser string without causing undue delay of the drilling process. The blow out preventer or module thereof can then, e.g., be subject to inspection and/or maintenance, which enhances safety of subsea drilling, e.g. in great water depths. Also great progress is made in the deployment process in view of repetitive testing of the leak tightness of the riser string, which is commonly done after three new riser sections have been added to the string. Wth the use of long riser sections a significant reduction of the number of pressure tests may be required, or testing may be done with less time pressure per test to be performed.

In order to benefit optimally from the invention it is envisaged that the main storage of riser sections onboard a vessel is embodied as storage for first length riser sections, so that a majority, e.g. at least 60%, of the riser string length that is stored onboard the vessel, is stored as these first length riser sections or riser stands. For example the storage racks are embodied to store therein at least 6000 ft. in total of first length riser sections or stands, e.g. at least 40 riser sections or stands of 150 ft. each.

In an embodiment the main riser pipe has a wall thickness and in the riser string the wall thickness of riser sections in a lower part is less than the wall thickness of riser section in an upper part of the riser string. For example the wall thickness of the riser section is adapted to the depth rating of the buoyancy members of the riser section, with riser sections having a greater depth rating having a main riser pipe with a wall thickness that is reduced compared to riser sections having a lower depth rating. This may be beneficial in view of the total dry weight of the riser sections, in particular of the greater depth rating riser sections that carry rather heavy buoyancy members in view of the depth rating. It will be appreciated that this design can be integrated in any riser string having interconnected riser section, independent of length of the individual sections and or the presence of tensile load sharing. However combination thereof with a riser section according to one or more of the aspects discussed herein is advantageous.

In an embodiment the flanges of the riser section may have a circular outer contour, yet in another embodiment a non-circular contour is possible, e.g. with two flange tabs similar to a butterfly shape with the choke line and kill line extending through a bore in a respective flange tab.

The storage racks may also be embodied to store therein at least 1500 ft. in total of second length riser sections, e.g. at least 20 riser sections of 75 ft. each.

Possibly also some so-called pup sections of very limited length that are commonly employed in the industry can be stored onboard, e.g. within the riser storage.

Further riser string items like a telescopic joint, hang-off joint, etc. can also be stored onboard the vessel.

In an embodiment, it is envisaged that the relative shorter (nowadays common) second length riser sections will be provided with buoyancy members that are to be fitted in a lower part of the riser string, so with buoyancy members that have a high depth rating. Commonly buoyancy members have increasing specific weight and overall mass as the depth rating increases in view of the water pressure to which the buoyancy member is subjected which increases with water depth. It is envisaged that fitting first length riser sections stored in the storage with high depth rating buoyancy members would result in a total weight of each riser section that renders the handling thereof very difficult, e.g. in view of sagging when held horizontally when conveyed by an overhead beam crane. Therefore, in an embodiment, it is envisaged that multiple first length riser sections and multiple second length riser sections are each provided with buoyancy members, wherein the buoyancy members of the second length riser sections have a greater depth rating than the buoyancy members of the first length riser sections. So the shorter elements have the relatively heavy buoyancy members and the longer elements of the riser string have the relative light buoyancy members, so that handling of both can be done effectively.

Embodiments of the inventive riser string allow to harmonize the top tension requirements of the riser string and associated tensioner system with the ease of handling individual riser sections in the process of assembly or tripping of the riser string and in the process of moving the riser sections out of and into the storage.

In an embodiment the vessel is provided with a catwalk machine having a mobile catwalk machine frame that is movable over horizontal rails, wherein the catwalk machine frame has a rear end and a front end, and is movable over the horizontal rails at least in a loading position and in a riser upending position. The catwalk machine frame has two parallel and horizontal frame beams, and a skate is supported by said frame beams and travels over the frame beams. The skate comprises a riser end support to support thereon a rearward end of a riser section or riser stand. The horizontal frame beams of the catwalk machine frame define between them an opening having a width so as to allow for the vertical passing of a single riser section in horizontal orientation through said opening, e.g. being raised by means of a transfer elevator arranged in a riser storage hold.

In addition to the skate the catwalk machine comprises one or more additional riser support members that are movable between an inactive position allowing for the mentioned vertical passage of the single riser section or single riser stand and an active position wherein the riser section or riser stand is supported on said riser support member.

The frame beams of the catwalk machine may be rigidly interconnected by a transverse beam near the rear end of the catwalk machine frame, and the frame beams may be interconnected by one or more mobile transverse connectors that are each movable between an inactive position allowing for said vertical passage of the single riser section or single riser stand and an active position wherein the transverse connector interconnects the frame beams, e.g. the catwalk machine frame having a single transverse connector at the front end of the catwalk machine frame. The provision of one or more mobile transverse connectors allows for the length of the catwalk machine frame to be significantly less than the length of the transfer opening and less than the length of the first length riser section as the first length element can pass in vertical direction, e.g. by means of the transfer elevator, when the connectors are in their inactive position.

In an embodiment the catwalk machine is provided with a tailing-in arm device that is mounted at the forward end of the catwalk machine frame. For example one tailing-in arm is arranged on each main beam of the frame, with the arms being movable into an operative position to act in unison when tailing-in the riser section or stand during the last stage of the upending process. The mounting on the catwalk machine causes the tailing-in arm device to move along with the catwalk machine, and thus it forms no obstacle near the firing line when the catwalk machine is retracted, e.g. when not in use. In an alternative the tailing-in arm device is supported on the vessel in a different manner, e.g. mobile in the tower.

In an embodiment the vessel is a monohull vessel and the riser storage is embodied to store the riser section and/or riser stands therein parallel to a longitudinal axis of the vessel.

In an embodiment the riser storage is within a riser storage hold and a riser transfer opening is arranged in the roof of the hold on the longitudinal midplane of the monohull vessel, preferably with the riser assembly firing line of the vessel also in said midplane.

In an embodiment the vessel has a moonpool and a tower is arranged at the moonpool, e.g. at a side of the moonpool or above the moonpool, e.g. as in WO2009/102196.

In an embodiment the vessel is provided with a riser string hanger that is adapted to suspended therefrom a riser string in a firing line into the sea.

In an embodiment the vessel has a tower, e.g. at a moonpool or above a moonpool, with the riser string assembly firing line e.g. extending through the moonpool, and a firing line hoisting device is provided, the hoisting device comprising a hanger device that is movable up and down relative to the tower. Preferably the hanger device is embodied as a travelling hanger device that is movable up and down along one or more vertical rails mounted on the tower, e.g. a wheeled travelling hanger device having wheels engaging one or more vertical rails. Preferably the hoisting device comprises at least one winch and at least one cable, wherein the hanger device is suspended from the at least one cable.

In an embodiment the moonpool has lateral sides, a front side and a rear side, and the tower is embodied as a hollow construction mast having a top and having a base that is integral with the hull, the base extending between sections of the hull on opposed lateral sides of the moonpool, the base being spaced from each of the front side and the rear side of the moonpool, thereby forming a front moonpool area forward of the mast and a rear moonpool area rearward of the mast, wherein the mast has a front side and an opposed rear side as well as opposed lateral sides. At one of said moonpool areas, preferably the rear moonpool area, the vessel is provided with a riser string assembly hanger that is adapted to suspended therefrom a riser string in a firing line into the sea during the riser assembly and disassembly process.

In a preferred embodiment the vessel has a riser string handling capacity hoisting device including a riser string lifting tool which is movable up and down relative to the mast and that is adapted to connect to an end of a riser section, and is embodied to support the weight of a riser string in the firing line when released from the riser string assembly hanger.

In a preferred embodiment the vessel has a second firing hoisting device, having a load attachment device which is movable up and down relative to the mast at a side opposed from the riser firing line, so as to allow for handling of items passing through the other moonpool area along a second firing line distinct and spaced from the first firing line where the riser string assembly takes place. Preferably said second hoisting device is embodied as a drilling drawworks, and is provided with a topdrive suspended from the load attachment device to perform drilling operations.

Preferably the vessel has a moonpool and the vessel is provided with a riser string support cart that is displaceable within the moonpool between the two firing lines allowing to assembly a riser string in a riser string assembly firing line, e.g. at the rear moonpool area, and then to transfer the riser string to a drilling firing line, e.g. at a front moonpool area. For example this cart is embodied as a skid cart that can be skidded over a pair of associated skid rails which extend in longitudinal direction along the moonpool, allowing to displace the cart in longitudinal direction of the moonpool while supporting a riser string (and preferably with a BOP attached to the lower end of the riser string) lowered into the sea, generally between the one moonpool area and the other moonpool area, so underneath the base of the mast.

In an embodiment the riser string support cart is also embodied to support a blow-out preventer or blow-out preventer module thereon, so with the cart underneath the blow-out preventer or module thereof.

Preferably one or both of the riser string handling capacity hoisting devices and—if present—the second firing line hoisting device comprises one or more cables and one or more associated winches.

Preferably one or both of the riser string handling capacity hoisting devices and—if present—the second firing hoisting device comprises a heave compensation mechanism.

It is envisaged that—if present—the riser transfer opening is oriented with its length towards the moonpool, preferably along or parallel to a central axis of the vessel if the vessel is a monohull vessel. E.g. the vessel has a riser storage hold aft of the moonpool. In an embodiment the vessel has a moonpool. At the moonpool a tower, e.g. a hollow construction mast, is arranged. The vessel is provided with a riser string hanger that is adapted to suspended therefrom a riser string in a firing line through the moonpool into the sea. A hoisting device is provided having a hanger device that is movable up and down relative to the tower, e.g. the hanger device being suspended from a cable connected to one or more winches.

It will be appreciated that any feature described with reference of one aspect of the invention, e.g. described as an optional or a required feature with respect to the first aspect of the invention, may be readily combined with one or more of the other aspects of the invention as described herein.

Figure 2:
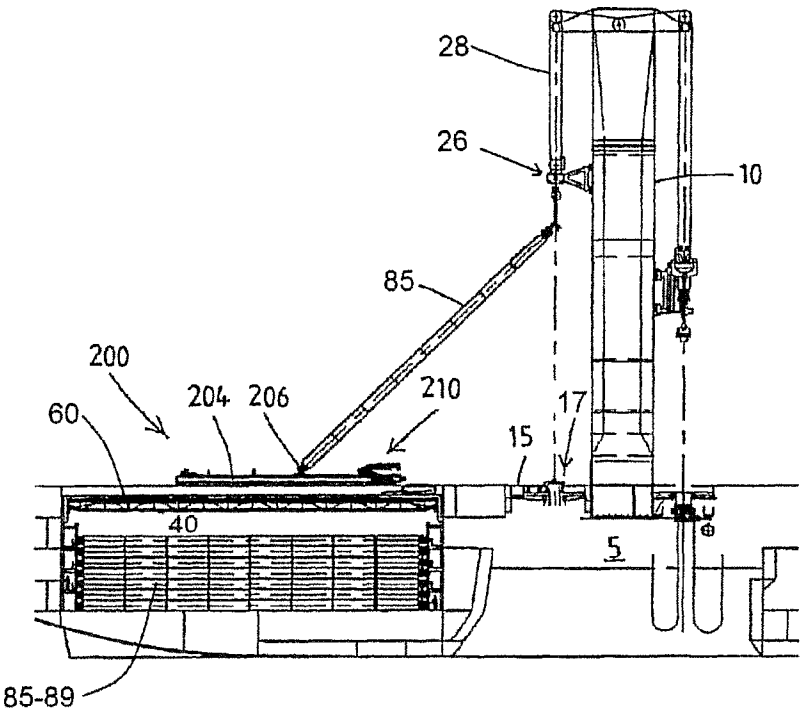
Figure 3:
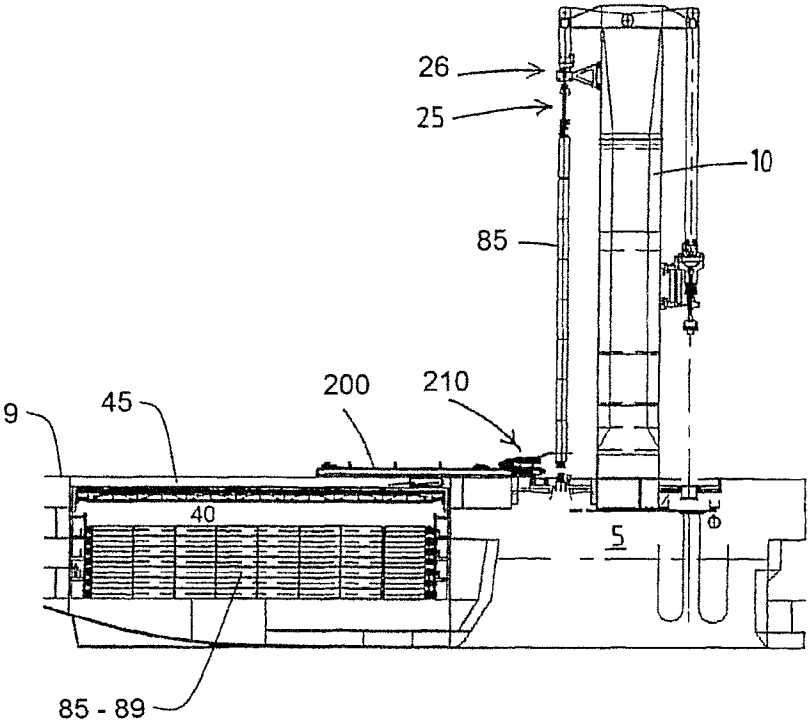
Figure 4:
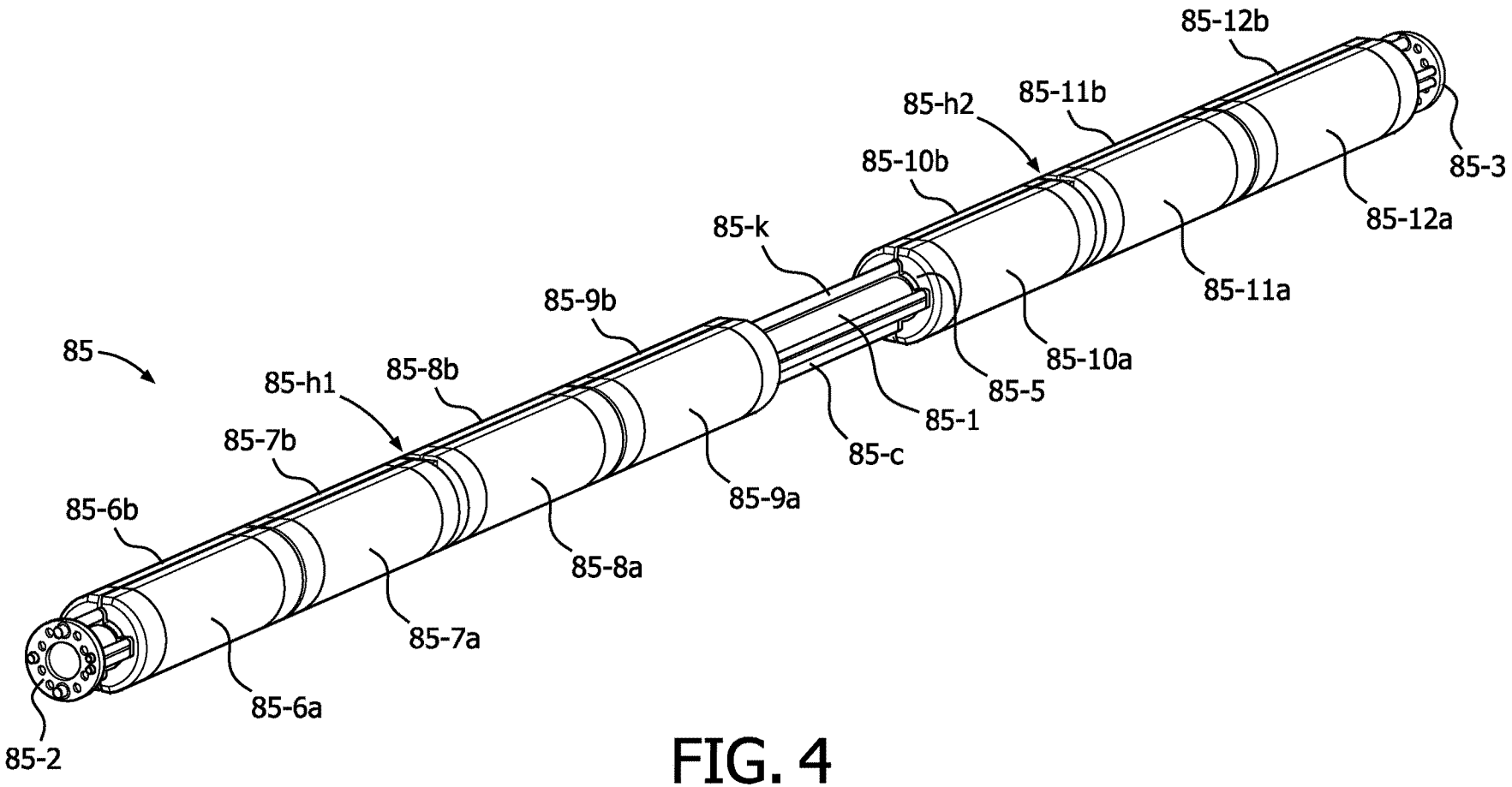
Figure 5:
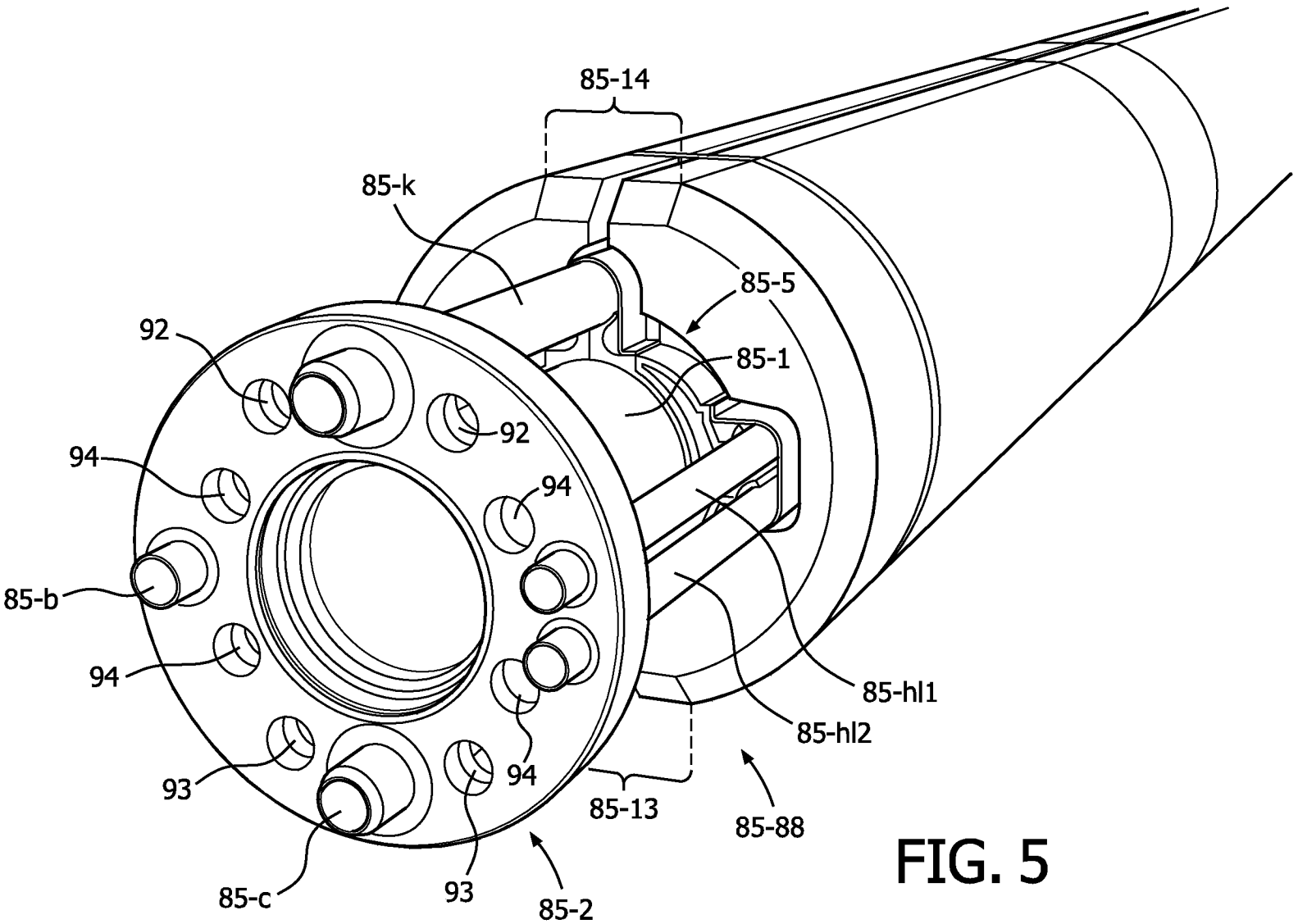
Figure 6:
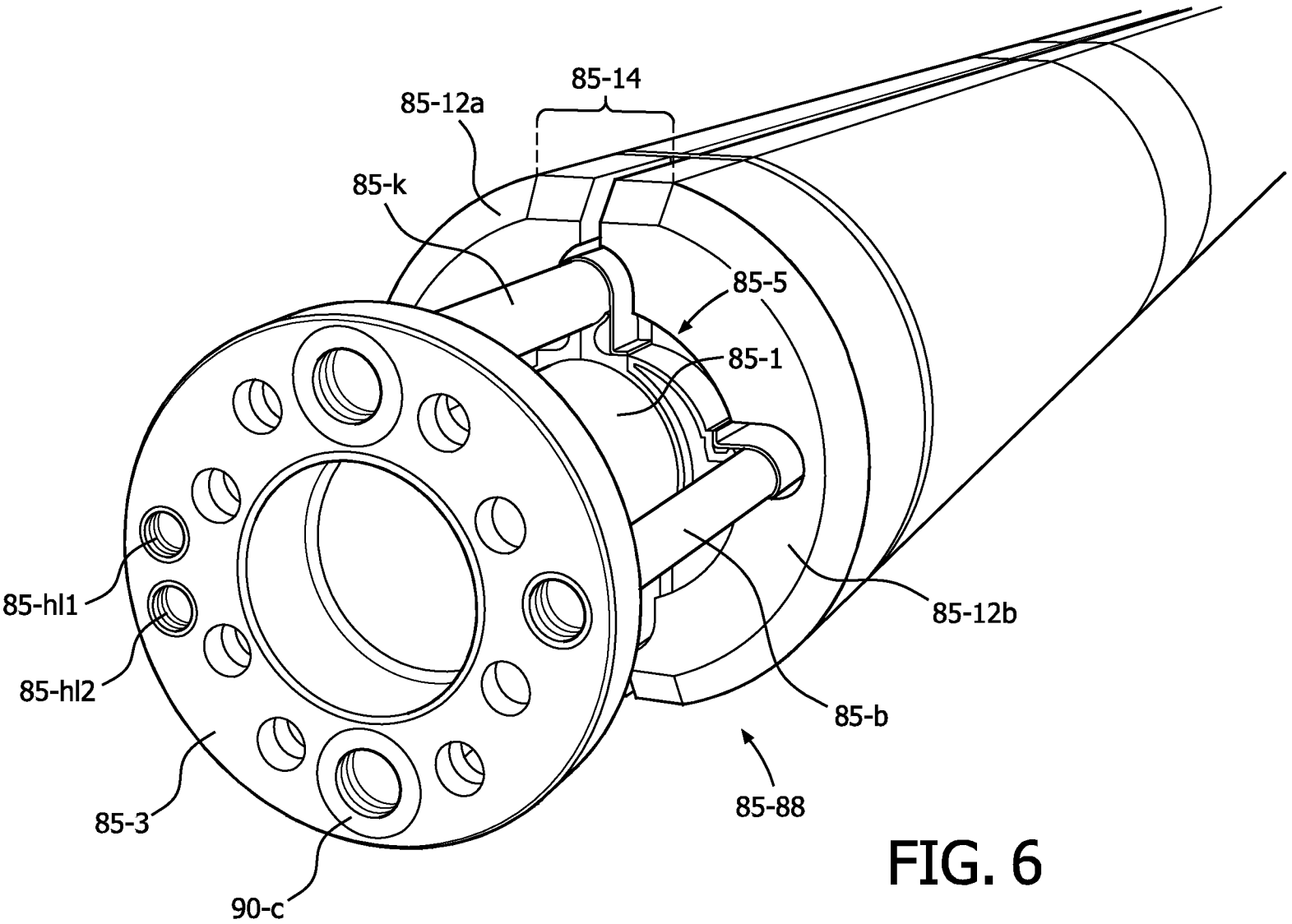
Figure 7:
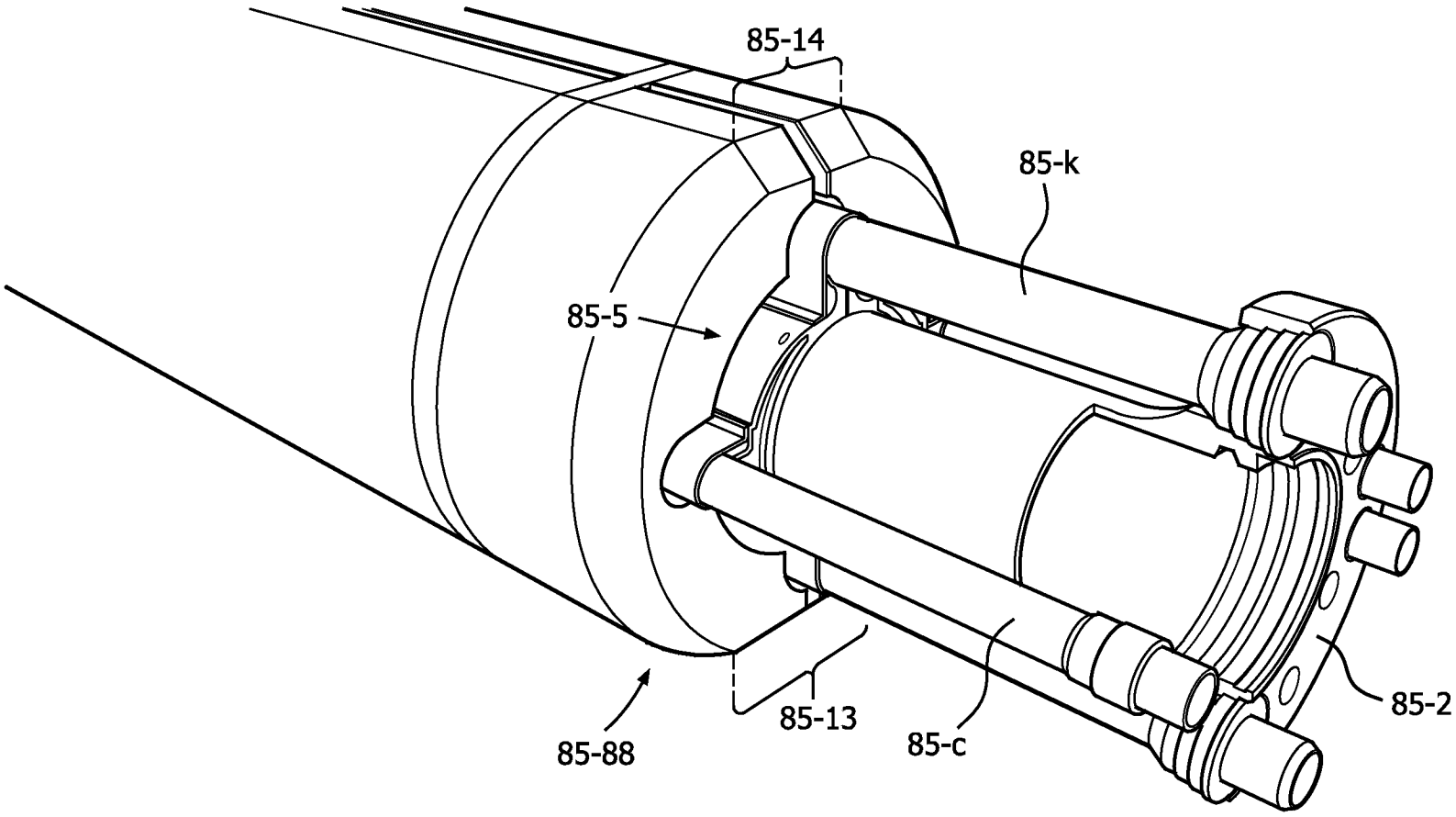
Figure 8:
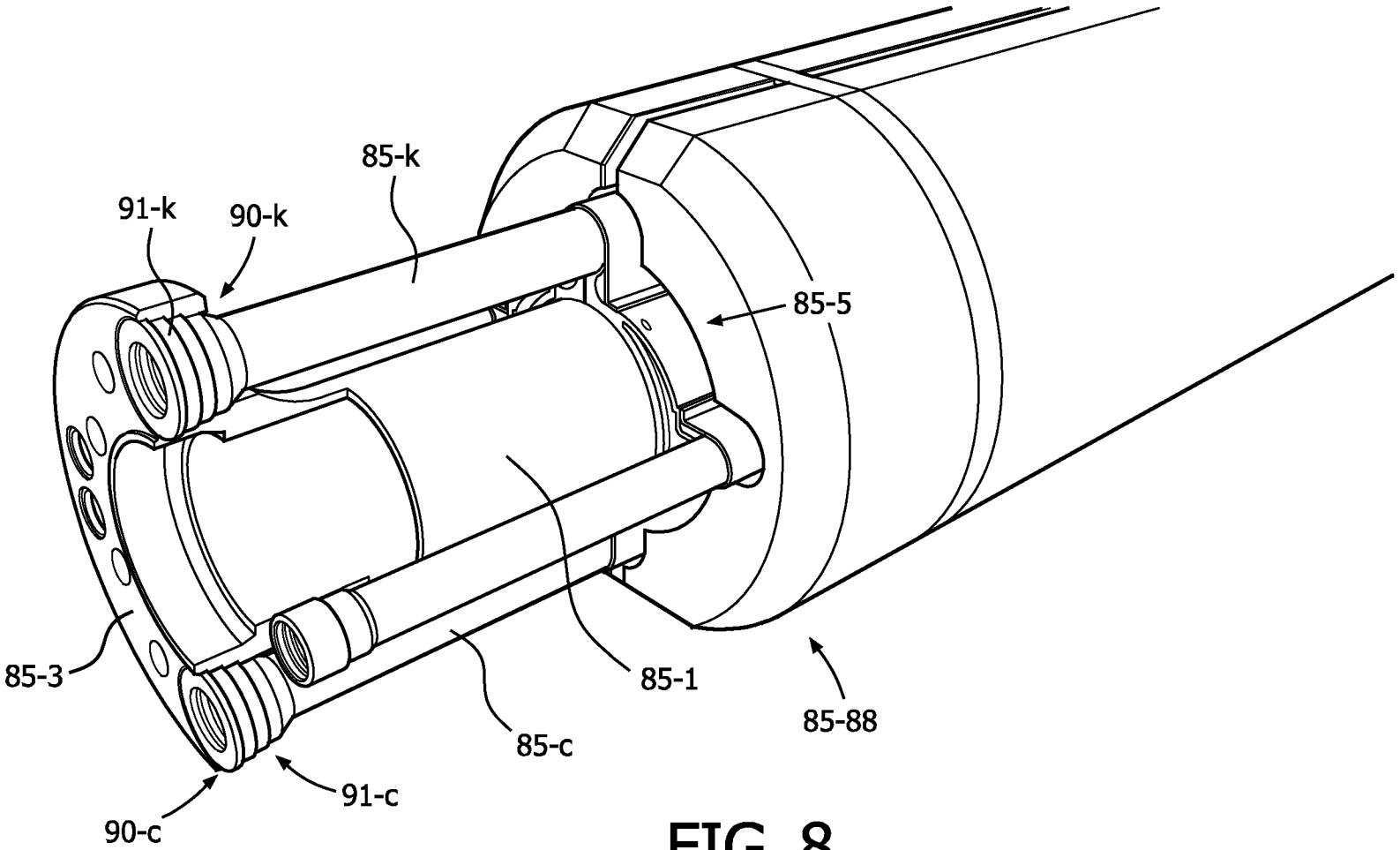
Figure 9A:
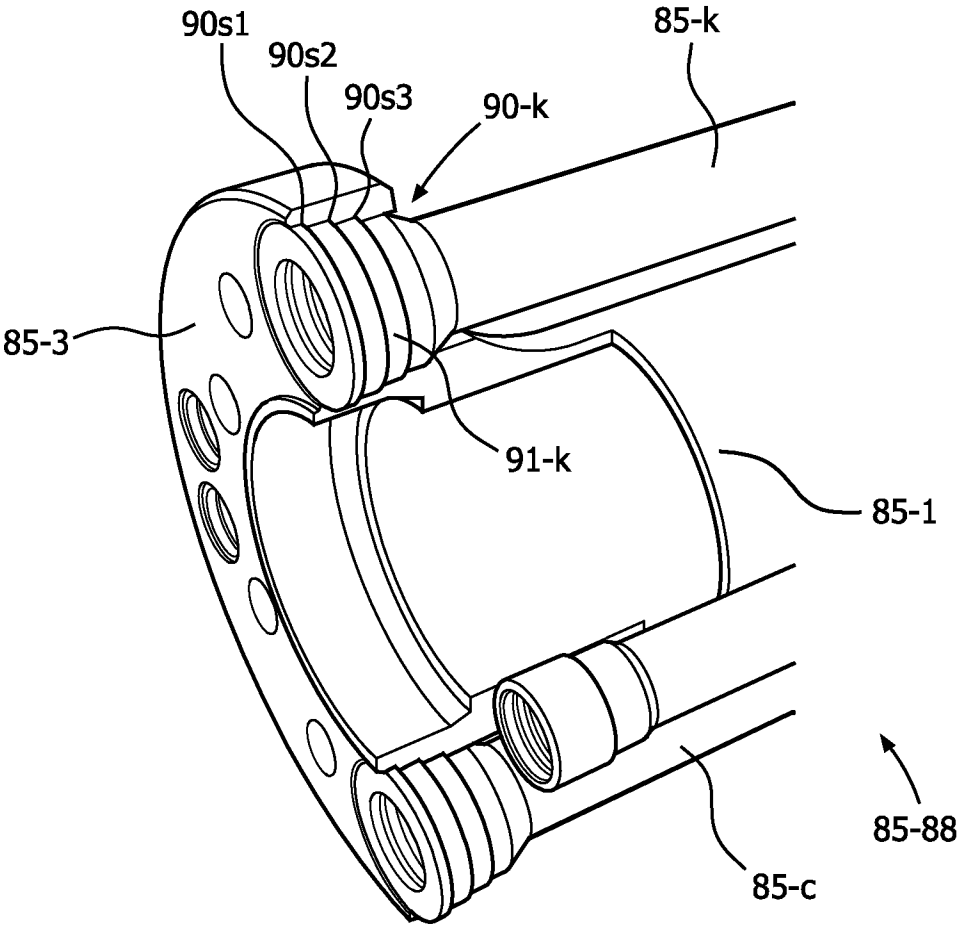
Figure 9B:
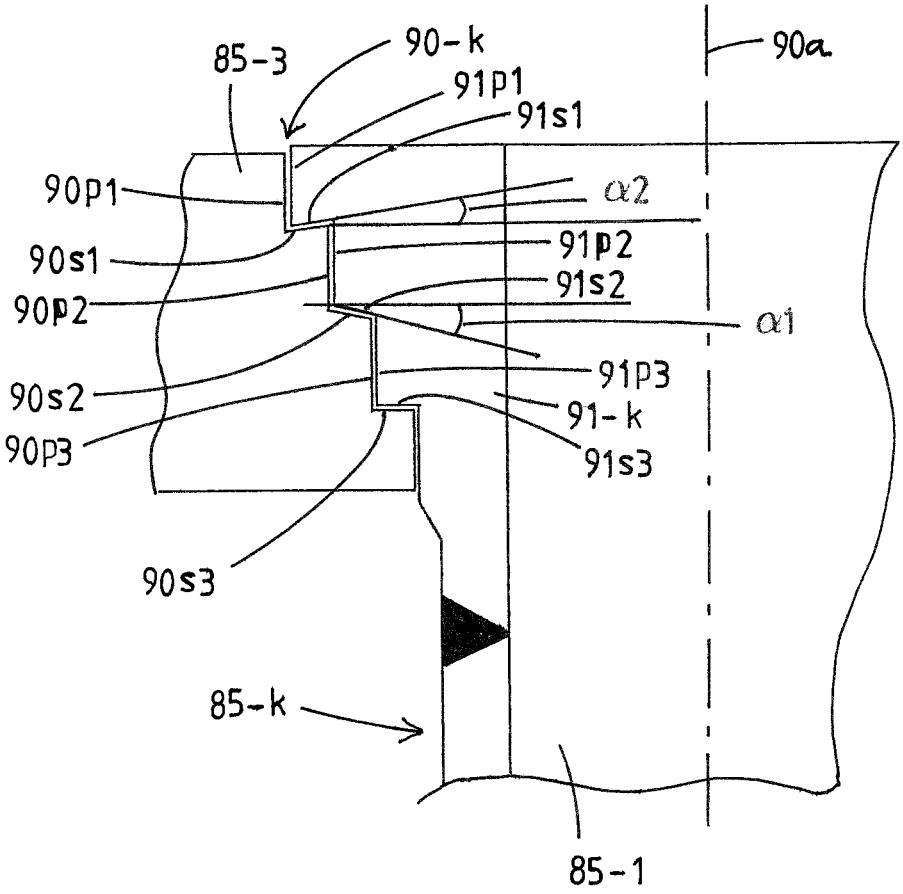
Figure 10:
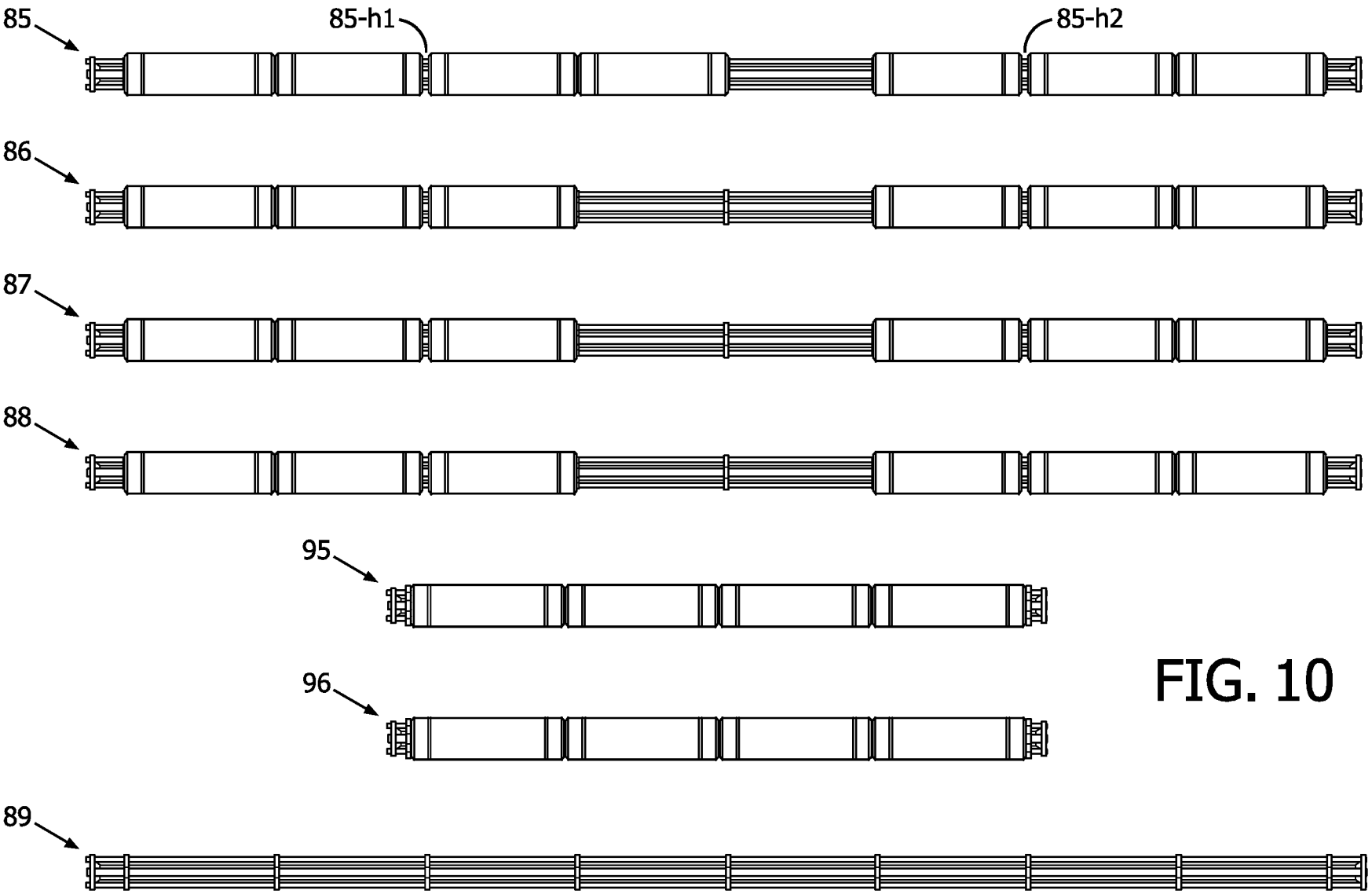
Figure 11:
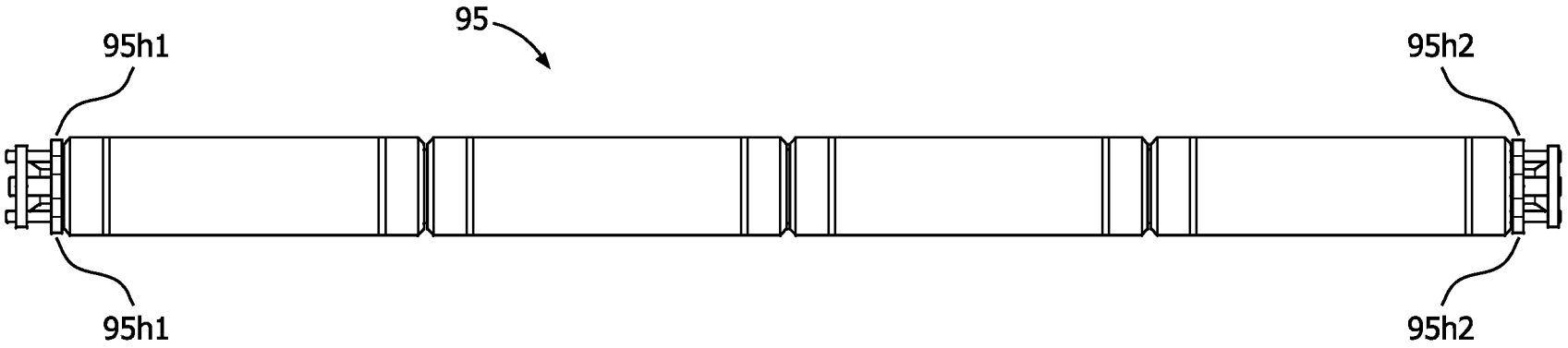

The invention will now be explained with reference to the drawings. In the drawings:

FIG. 1 shows in longitudinal view a part of a drilling vessel in the process of upending a riser section according to the invention, FIG. 2 shows the vessel of FIG. 2 during the process of upending a riser section, FIG. 3 shows the vessel of FIG. 1 with the riser section upended in the firing line, FIG. 4 shows a an embodiment of a riser section according to the invention, FIG. 5 shows one end of the riser section of FIG. 4, FIG. 6 shows the other end of the riser section of FIG. 4, FIG. 7 shows the end of FIG. 5 partly in cross section, FIG. 8 shows the end of FIG. 6 partly in cross section, FIG. 9*a* shows a detail of FIG. 8 on a larger scale, FIG. 9*b* illustrates design options of multi-step bore and end fitting, FIG. 10 illustrates an embodiment of a riser string according to the invention, FIG. 11 shows an embodiment of a second length, 75 ft. riser section.

FIG. 1 shows a part of a mono-hull vessel 1 having a hull 2 with a bow, a stern, and a moonpool 5 that extends through the hull 1.

For example the vessel may have one or more of the features of the vessel disclosed in WO2014/168471 and/or in non-prepublished NL 2013614 which are incorporated herein by reference. E.g. the vessel may have one or more features of the riser storage and/or riser handling as disclosed therein. E.g. use is made of the catwalk machine as described in NL 2013614.

The vessel 1 is adapted to perform subsea wellbore related operations involving a riser string between the subsea wellbore and the vessel, in particular drilling operations, e.g. for exploratory drilling. The vessel can also perform other subsea wellbore related operations, e.g. wellbore intervention.

The moonpool 5 has, as is preferred, a rectangular shape with opposed lateral sides, a front side and a rear side.

A front main deck extends fore of the moonpool 5. A rear main deck 9 extends between the moonpool 5 and the stern of the vessel.

The vessel is equipped with a tower 10, which is, as is preferred, embodied as a hollow construction mast having a top and having a base that is integral with the hull 2. The base extends between sections of the hull on opposed lateral sides of the moonpool 5 and the base is spaced from each of the front side and the rear side of the moonpool, thereby forming a front moonpool area forward of the mast 10 and a rear moonpool area rearward of the mast 10.

In this example, drill pipe racks, here embodied as carrousel type racks 14, are located adjacent the lateral sides of the mast 10, as is known in the art.

At the rear moonpool area, the vessel is provided with a working deck 15 arranged above the rear moonpool area. As is preferred the working deck 15 is a mobile working deck, here liftable along the mast 10 to such a height that a blow-out preventer BOP can be brought and held underneath the working deck 15 in raised position thereof at an elevated position relative to the mast 10. In a lowered, operative position, the working deck 15 preferably, as here, is level with the adjacent main deck area.

In view of assembly and disassembly of a riser string along a firing line 20 through the rear moonpool area the vessel is equipped with a riser string assembly hanger 17 that is adapted to suspended therefrom a riser string in the firing line 20 into the sea during the riser assembly and disassembly process. As preferred, this hanger 17 is mounted on the working deck 15, e.g. embodied as a riser spider, e.g. provided with a gimballing support so as to allow for angular variation between the riser string and the working deck, e.g. due to sea motion of the vessel.

The vessel 1 has a riser string handling capacity hoisting device including a riser string lifting tool 25 which is movable up and down relative to the mast 10 and that is adapted to connect to an end of a riser section, and is embodied to support the weight of a riser string in the firing line 20 when released from the riser string assembly hanger 17.

The riser string lifting tool 25 here is suspended from a travelling hanger device 26 that is movable up and down along the rear side of the mast 10 along one or more vertical rails 27.

The hanger device 26 is suspended by one or more cables 28 from a sheave arrangement 29 at the top of the mast, which one or more cables 28 are connected to one or more winches, e.g. arranged within the mast 10.

It is noted that the firing line 20 is outside of the rear side of the mast 10 so that the firing line 20 can be reached without hindrance in the process of upending a riser section from the rear of the vessel.

In an alternative embodiment, the mast 10 is replaced by a derrick type tower having a latticed frame with corner posts that forms a frame extending over the moonpool. It is then envisaged that the riser storage is outside of the derrick type tower and the derrick is provided with a V-door or similar to allow passage of a riser section or riser stand into and out of the derrick. As will be apparent from this application it is envisaged that a riser section may have a length of 150 ft., thereby requiring a V-door of significant height to allow for passage of the riser section during upending and during reverse motion during tripping of the riser string.

The vessel also has a second hoisting device having a load attachment device 30 which is movable up and down relative to the mast at a side opposed from the riser firing line 20, so as to allow for handling of items passing through the other moonpool area along a second firing line 21 distinct and spaced from the first firing line 20 where the riser string assembly takes place.

The second firing line 21 extends through the front moonpool area. Along this firing line 21 primarily drilling operations are performed.

The second hoisting device is embodied as a drilling drawworks, and is provided with a topdrive 31 suspended from the load attachment device 30 to perform drilling operations. The load attachment device 30 is preferably embodied similar as the travelling hanger device 26.

A working deck 32, e.g. a mobile working deck, is arranged above the fore moonpool area and may include a rotary table, iron roughneck machine, etc.

The vessel 1 is thus capable of assembly of a riser string in firing line 20. For transfer of the riser string to the other firing line 21 a riser string support cart is provided that is displaceable within the moonpool, e.g. skiddable over rails along the lateral sides of the moonpool 5.

The vessel has a riser storage hold 40, here as is preferred, within the hull 2 aft of the moonpool 5.

The riser storage hold 40 comprises storage racks adapted to store therein parallel stacks of multiple riser sections in horizontal orientation.

The riser storage hold is provided with first length storage racks adapted to store therein single first length riser sections 85-89 (see FIG. 10) each having a length of at least 100 ft. (30.48 m), e.g. of 120 ft. (36.57 m) or 150 ft. (45.72 m). In the example depicted in the figures the first length is 150 ft.

The riser storage hold is preferably also provided with second length storage racks adapted to store therein single second length riser sections 95,96 each having a length of between 50 ft. (15.24 meters) and 90 ft. (27.43 meters), e.g. of 75 ft. (22.86 meters). In the example depicted in FIGS. 10, 11 the second length is 75 ft.

The second length storage racks may be arranged in sets of two, with the two racks being in line with one another and parallel to the adjacent longer first length storage racks.

A first group of first length storage racks 80 may be arranged adjacent one side of a transfer station and a second group of first length storage racks 80 may be arranged adjacent another side of the transfer station.

Each storage rack may comprise at ends thereof a pair of adjacent riser end support columns that form a vertical slot which is adapted to receive therein an end portion, e.g. a flange, of a riser section 85-88, 95, 96.

The riser storage hold has a floor, port and starboard side walls, and a roof. An elongated riser transfer opening is present between the deck 9 and the roof.

The riser transfer opening extends in a direction parallel to the storage racks and has a length, here of at least 150 ft., and a width so as to allow for transfer of a single riser section in horizontal orientation via the riser transfer opening out of and into the riser storage hold.

Within the storage 40 a riser transfer station is arranged below the riser transfer opening 45. The station is provided with a transfer elevator that is adapted to raise and lower a single riser section or a single riser stand in horizontal orientation thereof so as to pass the riser section or a riser stand through the riser transfer opening 45.

In the storage hold 40 an overhead travelling beam crane 60 is arranged.

The crane 60 is capable of lifting and lowering a single riser section 85-88, 95, 96, either of first length or of second length as described herein, at least allowing for removal of a single riser section from a storage rack and for placing a single riser section 85-88, 95, 96 or into a storage rack respectively. The crane 60 is also capable of transverse transportation of a single riser section 85-88, 95, 96 at least between the transfer station 50 and a position above each of the storage racks in the storage 40.

The crane 60 comprises:

- a travelling beam extending in a direction parallel to the storage racks and supported at each end thereof on a crane rail perpendicular to the storage racks, here transverse to the hull
- a winch trolley provided with one or more winches and displaceable along the travelling beam,
- an elongated gripper frame suspended by one or more winch driven cables from the winch trolley. The gripper frame is provided with two riser grippers that are each adapted to engage on a single riser section 85-88, 95, 96 at spaced gripping locations thereof.

The gripper frame 68 is provided with two riser grippers that are adapted and arranged to engage on hooks **95*h*1, 95*h*2 that are fitted on the end portions of second length riser section, here on end portions of a 75 ft. riser section. As can be seen in FIG. 11** it is envisaged that at one end there may be two hooks, directed in diametrically opposed directions; one downward and one upward when the riser section is stacked on a flat surface portion thereof. These flat surface portions are formed by buoyancy members of the riser section and are as preferred provided alongside the choke line and the kill line of the riser section.

The two riser gripper engageable portions, here pairs of hooks **95*h*1, 95*h*2, 140, have a spacing the same as the spacing between hooks 85*h*1, 85*h*2, etc., arranged on the longer riser sections 85-88** so as to allow said two riser grippers to engage on said gripper engageable portions.

The crane 60 is also adapted to transfer a second length riser section between each of the second length storage racks and the transfer station, and to transfer a first length riser section between each of the first length storage racks and the transfer station.

The transfer elevator may comprise one or more elevator units, e.g. two units spaced apart in direction parallel to the storage racks.

The vessel, e.g. the riser storage hold 40, may be provided with one or more elongated riser workshops, each having a length at least sufficient to receive therein a first length riser section or stand. Each riser workshop has a floor, and, as is preferred also walls and a roof.

Each riser workshop is preferably arranged parallel to the storage racks and the workshop is adapted to accommodate at least one riser section 85-88, 95, and 96 in horizontal orientation.

The vessel is preferably provided with movable hatches which in a closed position thereof close the transfer opening 45 and in an opened position thereof open the transfer opening. e.g. pivotal hatches.

Substantially horizontal rails extend along opposite longitudinal sides of the riser transfer opening The vessel comprises a riser horizontal transport device 200 that is mounted on horizontal rails and is adapted to receive and hold a riser section 85-88, 95, 96 that has been raised through said transfer opening by the riser elevator unit or units and to horizontally transport the riser section 85-88, 95, 96 or riser stand so that a leading end thereof is connectable to a riser string lifting tool that is adapted to support the weight of a riser string in the firing line 20 of the vessel.

The riser horizontal transport device comprises a catwalk machine having a mobile catwalk machine frame that is movable over the horizontal rails 150. The catwalk machine frame has a rear end and a front end and is movable over the horizontal rails 150 at least in a loading position generally above the transfer opening and in a riser upending position closer to the firing line 20.

The catwalk machine frame may have two parallel and horizontal frame beams. At the rear end the beams may be rigidly and permanently interconnected by a transverse beam. The beams may be less long than the transfer opening and the first length riser section that is stored in the hold 40, e.g. less long than 150 ft. In order to obtain a sturdy frame during transportation of the riser section it is envisaged that, here only at the front end, the frame beams may be interconnected by a mobile transverse connector that is movable between an inactive position allowing for vertical passage of the single riser section or single riser stand and an active position wherein the transverse connector interconnects the frame beams. When lifting and lowering a section of first length the connector is inactive or opened. A shorter second length may be handled with the connector remaining closed as the opening in the frame of the machine is then large enough.

A skate 206 is supported by the frame beams and travels over the frame beams. As is known in the art the skate 206 comprises a riser end support to support thereon a rearward end of a riser section 85-88, 95, 96.

As will be appreciated the horizontal frame beams of the catwalk machine frame define between them an opening having a width so as to allow for the vertical passing of a single riser section 85-88, 95, 96 (equipped with buoyancy members) in horizontal orientation through said opening, preferably by means of the transfer elevator unit or units.

The catwalk machine, in addition to the skate 206, may comprise one or more additional riser support members that are movable between an inactive position allowing for said vertical passage of the single riser section 85-88, 95, 96 or single riser stand and an active position wherein the riser section or riser stand is supported on said riser support member.

If desired the catwalk machine 200 is provided with a tailing-in arm device 210, e.g. with one tailing arm fitted to the front end of each beam.

With reference to FIGS. 4-9 now the first, second, third, and fourth aspect of the invention will be illustrated.

FIG. 4 depicts a marine riser section 85, in this example having, as is preferred, a length of 150 ft.

The riser section 85, which is also called riser joint in the industry, comprises a main riser pipe 85-1, which main riser pipe has a longitudinal axis and a length. In this example a 21 inch OD riser pipe 85-1 is shown, having an inner diameter of 18.75 inch.

As is preferred the main riser pipe is a continuous pipe having a wall of solid steel. In an embodiment the main riser pipe, and possibly the flanges, could e.g. be made of aluminium or another metal like titanium.

For example the main riser pipe is made of X80 steel, e.g. having a yield strength of 555 MPa.

The main riser pipe 85-1 is provided with a radially extending flange 85-2, 85-3, at each end thereof.

As is preferred and known in the art each flange 85-2, 85-3 is a steel flange welded to the continuous main riser pipe body at an axial end thereof.

The flanges could be made of the same steel as the main riser pipe.

The flanges may each have been manufactured as a single casted metal object with a main riser pipe end piece, that is appropriately machined and is welded or otherwise secured on the end of the main riser pipe body.

The figures illustrate that multiple auxiliary pipes are disposed on the outside of and parallel to the main riser pipe.

These auxiliary pipes at least comprise a choke line **85-*c* and a kill line 85-*k***.

In this example, as preferred, also a booster line **85-*b* is provided. Additionally one or more, here two, hydraulic lines 85-*hl*1, 85-*hl*2**, are provided. As shown the two hydraulic lines are arranged closely together, diametrically opposite the single booster line of this exemplary riser section.

As can be seen, the one or more auxiliary lines **85-*b*, 85-*hl*1, 85-*hl*2, additional to the choke line and kill line are arranged close to, here the two hydraulic lines, or in, here the booster line, a horizontal plane intersecting the main riser pipe axis when the riser section 85** is lying horizontally with the choke line and kill line in a vertical plane through said axis.

The riser section 85 also comprises clamps 85-5 that are distributed along the length of the main riser pipe 85-1 and are secured by clamping to said main riser pipe 85-1. These clamps 85-5 are adapted to retain at least the choke line **85-*c* and the kill line 85-*k* relative to the main riser pipe 85-1**.

The riser section 85 is also provided with a series of pairs of buoyancy members **85-6*a, b*, 85-7*a, b* . . . , 85-12*a, b*. Each of the pair of buoyancy members is semi-annular in cross-section so that the pair together makes up an annulus, with some gapes therein, around the circumference of the riser section. For example the buoyancy members are fitted by means of straps encircling the buoyancy members and pressing them onto the main riser pipe, e.g. with a resilient member in between. Alternative securing arrangements are also possible, possibly in combination with straps, e.g. axial stop members can be provided on the main riser pipe, e.g. like collars and/or integrated with the clamps 85-5** that prevent the buoyancy members from sliding axially with respect to the main riser pipe.

As shown in FIG. 4, in cross section each of the pair of buoyancy members has a semi-circular outer side. That is, the pair of buoyancy member comprises, in cross section, a circular outer edge, wherein the top and bottom of the circular outer edge are levelled off to create parallel flat bottom and top stacking faces relative to the axis of the main riser pipe.

As explained it is preferred for the riser section 85-88 to have a length of at least 100 ft. (30.48 m), e.g. of 120 ft. (36.57 m), e.g. of 150 ft. (45.72 m).

At least the choke line **85-*c* and the kill line 85-*k* are connected to each of the flanges 85-2, 85-3** in a tensile load sharing arrangement with a tensile load transferring connection assembly between each of the choke line and kill line and each of the flanges, so that—in vertical use orientation of the riser section in a riser string—weight stress is distributed in the main riser pipe and the choke line and the kill line.

As can be seen the buoyancy members form an exterior of the riser section including diametrically opposed and parallel flat bottom and top stacking faces 85-13, 85-14, relative to the axis of the main riser pipe 85-1, allowing stacking of riser sections 85 in horizontal orientation with the flat bottom stacking face 85-13 resting on the flat top stacking face 85-14 of an underlying riser section 85.

The choke line 85-*c* and the kill line 85-*k* are arranged diametrically opposite from one another relative to the axis of the main riser pipe 85-1 and between the flat bottom and top stacking faces 85-13, 85-14, as is preferred in a plane normal to the flat bottom and top stacking faces.

As can be seen, in this example, the auxiliary lines protrude at the side of the flange 85-2, whereas the at the other flange 85-3 the auxiliary lines are embodied to receive therein the protruding ends of the auxiliary lines of an adjacent riser section. This interconnection of auxiliary pipes need not be designed to transfer axial load from one auxiliary riser pipe to the next, but in embodiment a clip connector, bayonet connector or the like may be present to mechanically interconnect the auxiliary pipes of adjoining riser sections.

The tensile load transferring connection assembly between each of the choke line 85-*c* and kill line 85-*k* and each of the flanges 85-2, 85-3, is embodied such that—when upending the riser section 85 from a horizontal orientation to a vertical orientation by lifting one end of the riser section—the upper one or the choke line and kill line does not carry a compressive load. This avoid undue loading that may induce buckling of the one line that is on top of the riser section when it is being lifted at one end in the upending process.

As can be seen, e.g. in FIGS. 8, 9*a, b* a tensile load transferring connection assembly comprises:

- a multi-stepped bore 90-*c*, 90-*k*, through the flange 85-3, which bore has an axis 90-*a* and which bore has multiple adjoining step portions, each step portion including a peripheral surface 90*p*1, 90*p*2, 90*p*3, and a shoulder surface 90*s*1, 90*s*2, 90*s*3, with the axially spaced shoulder surfaces of the multi-stepped bore having stepwise decreasing diameter relative to one another when seen in direction of the tensile load on the choke line or kill line, here a three stepped bore with three shoulder surfaces,
- a multi-stepped end fitting 91-*c*, 91-*k* arranged on the respective auxiliary pipe 85-*c*, 85-*k*, here welded onto the end of a steel pipe 85-*k*.

The end fitting has multiple adjoining step portions, each step portion including a peripheral surface 91*p*1, 91*p*2, 91*p*3, and a shoulder surface 91*s*1, 91*s*2, 91*s*3, with the axially spaced shoulder surfaces of the multi-stepped end fitting having stepwise decreasing diameter relative to one another when seen in direction of the tensile load on the choke line or kill line, here a three stepped end fitting with three shoulder surfaces.

The shoulder surfaces 90*s*1, 90*s*2, 90*s*3 of the multi-stepped bore and the shoulder surfaces 91*s*1, 91*s*2, 91*s*3 of the multi-stepped end fitting are adapted to simultaneously contact one another, at least when the auxiliary line is subjected to significant tensile load, so as to distributed the tensile load to be transferred between the flange and the auxiliary pipe over these multiple, here three, pairs of mating shoulder surfaces.

As is preferred the peripheral and shoulder surfaces of the multi-stepped bore and the mating end fitting have rotational symmetry relative to the coinciding axes of the auxiliary pipe and of the bore through the flange for said auxiliary pipe.

In an embodiment at least one pair of contacting shoulder surfaces, here 90*s*3, 91*s*3, of the multi-stepped bore and end fitting are located in a plane normal to the axis 90-*a* of the bore.

In an embodiment at least one pair of contacting shoulder surfaces, here 90*s*2, 91*s*2, of the multi-stepped bore and end fitting are located in a conical plane that tapers, here angle $\alpha$1, when seen in direction of tensile load on the choke line or kill line, said conical plane having an angle of at most 20° relative to a plane that is normal to the axis 90-*a* of the bore.

In an embodiment at least one pair of contacting shoulder surfaces, here 90*s*1, 91*s*1, of the multi-stepped bore and end fitting are located in a conical plane that widens when seen in direction of tensile load on the choke line or kill line, said conical plane having an angle, here angle $\alpha$2, of at most 20° relative to a plane that is normal to the axis of the bore.

In an embodiment, e.g. at one end of a auxiliary pipe, the multi-stepped end fitting may be embodied as a nut, wherein the respective auxiliary pipe is provided with a threaded portion onto which the nut is screwed allowing to adjust the position of the end fitting, e.g. the auxiliary pipe having a steel pipe end piece welded on a steel main body of the auxiliary pipe.

In an embodiment a lock nut is also provided on the threaded portion of the auxiliary pipe allowing to lock the multi-stepped end fitting nut in a desired position.

In an embodiment the bore 90-*c*, 90-*k*, for the auxiliary pipe in the flange has a length of between 4 inch and 8 inch, e.g. between 5 and 7 inch, e.g. 6 inch.

The figures also illustrate that the flange 85-2, 85-3, is provided with two bolt holes 92, 93 for connector bolts that interconnect adjoining riser sections, near each of the kill line bore and the choke line bore in the flange, one bolt hole on each side of the respective kill line and choke line. The flange is furthermore provided with two additional pairs of bolt holes 94 for connector bolts that interconnect adjoining riser sections, said additional pairs each being arranged on opposite sides of the main riser pipe, the bolt holes of each pair being distributed between the bolt holes adjacent the respective choke line and kill line.

As is preferred the riser pipe 85-1 is a metal pipe, preferably a steel pipe, and the clamps 85-5 have a metal, preferably steel, discontinuous clamping band with multiple band members that are in direct metal-to-metal contact with the metal main riser pipe. The clamp comprises one or more fasteners to secure the band members to one another and to create a friction clamping of the clamping band onto the main riser pipe. This friction is such that—when lifting one end of the riser section 85 in the process of upending the riser section from the horizontal orientation into the vertical orientation—the band of the clamp holding the choke line and kill line remains in place relative to the riser pipe.

As has already been discussed with reference to shorter riser section 95, the riser section 85 has two riser gripper engageable portions, here hooks 85-*h*1, 85-*h*2 having a spacing corresponding to the spacing between hooks on the 75 ft. (22.86 meters) riser section.

A hook may be integrated with a collar that is fitted, e.g. clamped, around the main riser pipe.

Whilst the aspects of the invention are discussed with reference to riser section 85, it will be appreciated that riser sections 86, 87, 88 may, and preferably do, comprises the same structural features as the riser section 85. The main difference lies in the depth rating of the buoyancy members that are fitted on the riser sections, which are here defined by four sections each corresponding to an additional 2000 ft. of water depth as illustrated by way of example in FIG. 10.

FIG. 10 also illustrates the presence of a lowermost part of a riser string, made up from one or more bare 150 ft. riser sections 89, e.g. at a depth below 12.000 ft., e.g. to a depth of 13.200 ft.

Intermediate the 8.000 ft. and 12.000 ft. water depth the example of FIG. 10 illustrates that the lower riser string part is composed of shorter, 75 ft. length riser sections, that may have the same connection between flanges and auxiliary lines, e.g. choke line and kill line as discussed with reference to longer section 85.

These below 8.000 ft. rated riser sections are provided with buoyancy members that have such a great dry weight that their handling would become cumbersome and stress undue if their length also was 150 ft. Therefore, in view of efficient handling of all elements of the riser string, it is proposed to use the shorter length, e.g. 75 ft. for this lower part of the string. The lowermost bare sections can be longer again, e.g. 150 ft. as they have no buoyancy members due to the insignificant contribution such members would have to the buoyancy of the string.

The invention claimed is:

1. A marine riser section comprising:

a main riser pipe, said main riser pipe having an axis and a length, wherein said main riser pipe is provided with a radially extending flange at each end thereof;

multiple auxiliary pipes disposed on the outside of and parallel to the riser pipe, said auxiliary pipes comprising a choke line and a kill line;

one or more clamps distributed along the length of the main riser pipe and secured to said main riser pipe, said one or more clamps being adapted to retain said choke line and said kill line relative to the main riser pipe; and buoyancy members, wherein the choke line and the kill line are connected to each of the flanges in a tensile load sharing arrangement with a tensile load transferring connection assembly between each of the choke line and kill line and each of the flanges, so that —in vertical use orientation of the riser section in a riser string —weight stress is distributed in the main riser pipe and the choke line and the kill line, wherein the buoyancy members form an exterior of the riser section including diametrically opposed and parallel flat bottom and top stacking faces relative to the axis of the main riser pipe, allowing stacking of riser sections in horizontal orientation with the flat bottom stacking face resting on the flat top stacking face of an underlying riser section, the flat bottom and top stacking faces being parallel with the axis of the main riser pipe, and wherein the choke line and the kill line are arranged diametrically opposite from one another relative to the axis of the main riser pipe and between the flat bottom and top stacking faces, in a plane normal to a plane coplanar with the flat bottom stacking face or the flat top stacking face, and wherein the buoyancy members form the exterior of the riser section including diametrically opposed curved faces relative to said plane normal to the plane coplanar with the flat bottom stacking face or the flat top stacking face.

2. The marine riser section according to claim 1, wherein a tensile load transferring connection assembly comprises:

a multi-stepped bore through the flange, said bore having an axis and said bore having multiple adjoining step portions, each step portion including a peripheral surface and a shoulder surface, with the axially spaced shoulder surfaces of the multi-stepped bore having stepwise decreasing diameter relative to one another when seen in direction of the tensile load on the choke line or kill line; and a multi-stepped end fitting arranged on the respective auxiliary pipe, said end fitting having a multiple adjoining step portions, each step portion including a peripheral surface and a shoulder surface, with the axially spaced shoulder surfaces of the multi-stepped end fitting having stepwise decreasing diameter relative to one another when seen in direction of the tensile load on the choke line or kill line, wherein the shoulder surfaces of the multi-stepped bore and of the multi-stepped end fitting are adapted to simultaneously contact one another so as to distributed the tensile load to be transferred over said shoulder surfaces.

3. The marine riser section according to claim 2, wherein a pair of contacting shoulder surfaces of the multi-stepped bore and end fitting are located in a plane normal to the axis of the bore.

4. The marine riser section according to claim 2, wherein a pair of contacting shoulder surfaces of the multi-stepped bore and end fitting are located in a conical plane that tapers when seen in direction of tensile load on the choke line or kill line, said conical plane having an angle of at most 20° relative to a plane that is normal to the axis of the bore.

5. The marine riser section according to claim 2, wherein a pair of contacting shoulder surfaces of the multi-stepped bore and end fitting are located in a conical plane that widens when seen in direction of tensile load on the choke line or kill line, said conical plane having an angle of at most 20° relative to a plane that is normal to the axis of the bore.

6. The marine riser section according to claim 2, wherein the multi-stepped end fitting is embodied as a nut, and wherein the respective auxiliary pipe is provided with a threaded portion onto which the nut is screwed allowing to adjust the position of the end fitting.

7. The marine riser section according to claim 6, wherein a lock nut is also provided on the threaded portion of the auxiliary pipe allowing to lock the multi-stepped end fitting nut in a desired position.

8. The marine riser section according to claim 2, wherein the bore for the auxiliary pipe in the flange has a length of between 4 inch and 8 inch.

9. The marine riser section according to claim 2, wherein the flange is provided with two bolt holes near each of the kill line bore and the choke line bore in the flange, one bolt hole on each side of the respective kill line and choke line, and wherein, possibly the flange is furthermore provided with two additional pairs of bolt holes for connector bolts that interconnect adjoining riser sections, said additional pairs each being arranged on opposite sides of the main riser pipe, the bolt holes of each pair being distributed between the bolt holes adjacent the respective choke line and kill line.

10. The marine riser section according to claim 1, wherein the riser pipe is a metal pipe, and wherein a clamp has a metal, discontinuous clamping band with multiple band members that are in direct metal-to-metal contact with the metal main riser pipe, wherein the clamp comprises one or more fasteners to secure the band members to one another and to create a friction clamping of the clamping band onto the main riser pipe, and wherein the friction is such that—when lifting one end of the riser section in the process of upending the riser section from the horizontal orientation into the vertical orientation—the band of the clamp holding the choke line and kill line remains in place relative to the riser pipe, concerning its angular position relative the main pipe.

11. The marine riser section according to claim 1, wherein the riser section has a length of at least 100 ft., and wherein the riser section is provided at intermediate locations along the length thereof with two riser gripper engageable portions having a spacing corresponding to the spacing between end portions of a 75 ft. riser section.

12. The marine riser section according to claim 11, wherein each gripper engageable portion comprises a hook member fitted to the riser section.

13. A marine riser section comprising:

a main riser pipe, said main riser pipe having an axis and a length, wherein said main riser pipe is provided with a radially extending flange at each end thereof;

multiple auxiliary pipes disposed on the outside of and parallel to the riser pipe, said auxiliary pipes comprising a choke line and a kill line;

one or more clamps distributed along the length of the main riser pipe and secured to said main riser pipe, said one or more clamps being adapted to retain said choke line and said kill line relative to the main riser pipe, pipe; and buoyancy members, wherein the choke line and the kill line are connected to each of the flanges in a tensile load sharing arrangement with a tensile load transferring connection assembly between each of the choke line and kill line and each of the flanges, so that—in vertical use orientation of the riser section in a riser string—weight stress is distributed in the main riser pipe and the choke line and the kill line, wherein a tensile load transferring connection assembly comprises:

a multi-stepped bore through the flange, said bore having an axis and said bore having multiple adjoining step portions, each step portion including a peripheral surface and a shoulder surface, with the axially spaced shoulder surfaces of the multi-stepped bore having stepwise decreasing diameter relative to one another when seen in direction of the tensile load on the choke line or kill line; and a multi-stepped end fitting arranged on the respective auxiliary pipe, said end fitting having a multiple adjoining step portions, each step portion including a peripheral surface and a shoulder surface, with the axially spaced shoulder surfaces of the multi-stepped end fitting having stepwise decreasing diameter relative to one another when seen in direction of the tensile load on the choke line or kill line.

* * * * *